US009279324B2

(12) United States Patent
Clute et al.

(10) Patent No.: US 9,279,324 B2
(45) Date of Patent: Mar. 8, 2016

(54) REDUCED LEAKAGE BALANCE PISTON SEAL

(71) Applicants: Stephen G. Clute, Cuba, NY (US); Mark J. Kuzdzal, Allegany, NY (US); Glenn R. Grosso, Olean, NY (US); David J. Peer, Olean, NY (US)

(72) Inventors: Stephen G. Clute, Cuba, NY (US); Mark J. Kuzdzal, Allegany, NY (US); Glenn R. Grosso, Olean, NY (US); David J. Peer, Olean, NY (US)

(73) Assignee: Dresser-Rand Company, Olean, NY (US)

( * ) Notice: Subject to any disclaimer, the term of this patent is extended or adjusted under 35 U.S.C. 154(b) by 370 days.

(21) Appl. No.: 13/675,368

(22) Filed: Nov. 13, 2012

(65) Prior Publication Data

US 2013/0149101 A1 Jun. 13, 2013

Related U.S. Application Data

(60) Provisional application No. 61/567,710, filed on Dec. 7, 2011.

(51) Int. Cl.

| | |
|---|---|
| ***F01D 3/04*** | (2006.01) |
| ***F01D 11/04*** | (2006.01) |
| *F04D 29/22* | (2006.01) |
| *F01D 11/02* | (2006.01) |
| *F04D 29/041* | (2006.01) |

(52) U.S. Cl.

CPC ..... *F01D 3/04* (2013.01); *F01D 11/025* (2013.01); *F01D 11/04* (2013.01); *F01D 11/02* (2013.01); *F04D 29/0416* (2013.01); *F04D 29/2266* (2013.01)

(58) Field of Classification Search

CPC ..... F01D 3/04; F01D 11/02; F01D 11/025; F01D 11/04; F01D 11/08; F01D 11/003; F01D 25/168; F01D 5/02; F01D 5/08; F05D 2220/40; F05D 2220/52; F05D 2250/611; F16J 15/34; F04D 29/0516; F04D 29/041; F04D 29/051; F04D 29/0416; F04D 29/0513; F04D 29/2266

USPC ..... 415/104, 170.1, 174.3

See application file for complete search history.

(56) References Cited

U.S. PATENT DOCUMENTS

| | | | | |
|---|---|---|---|---|
| 4,132,416 | A * | 1/1979 | Adams, Jr. | 277/412 |
| 6,076,832 | A * | 6/2000 | Pow | 277/546 |
| 8,061,970 | B2 * | 11/2011 | Maier et al. | 415/104 |
| 8,177,475 | B2 * | 5/2012 | Joco et al. | 415/1 |

* cited by examiner

*Primary Examiner* — Dwayne J White
*Assistant Examiner* — Logan Kraft
(74) *Attorney, Agent, or Firm* — Edmonds & Nolte, PC

(57) ABSTRACT

Balance piston assembly, apparatus, and methods are provided. The assembly includes a balance piston coupled to a rotatable shaft and configured to rotate therewith, the balance piston including a first shelf and a second shelf, the first and second shelves being axially-overlapping and radially-offset. The assembly also includes a seal including a first sealing surface configured to seal with the first shelf and a second sealing surface configured to seal with the second shelf.

17 Claims, 8 Drawing Sheets

REDUCED LEAKAGE BALANCE PISTON SEAL

The present application claims priority to U.S. Application No. 61/567,710 filed Dec. 7, 2011. The priority application is hereby incorporated by reference in its entirety into the present application.

BACKGROUND

Balance pistons are often used in turbomachines to manage or control axial thrust loads generally created by pressure differentials along the axial length of the turbomachine shaft. In centrifugal compressors, for example, the balance piston typically includes a disk mounted to the shaft on the outboard side of an impeller, often the final stage impeller. A reference line fluidly connects the outboard side (i.e., the side facing away from the impeller) of the balance piston with process gas provided at a reduced pressure, generally suction pressure. Accordingly, the axial forces directed from the high-pressure impeller outlet toward the low-pressure suction inlet are at least partially offset by the pressure differential being experienced in the opposite direction across the balance piston. Remaining axial thrust loads are typically taken up by one or more axial bearings, which are known and available in a variety of designs.

A challenge inherent to the balance piston solution is that it generally adds an interface between a rotating component and a stationary component. Generally, such interface is sealed using any one of a variety of different types of seals. However, the efficacy of the seal is generally a function of the sealing surface area, and the sealing surface area is limited by the axial length of the balance piston. Moreover, it is generally desirable to limit the axial length of the balance piston, and thus minimize overall shaft length and weight.

Further, gas balance seals are used to prevent contamination or fouling of sensitive seals, such as dry gas seals, with dirty process gas, while allowing sensitive seals on both ends of the shaft to operate at the same pressure. Generally, such gas balance seals are provided by a pair of seals, e.g., labyrinth seals, disposed between the dry gas seals and the balance piston. Clean seal gas is then injected between the labyrinth seals, such that the seal gas leaks across the seals. For one of the labyrinth seals, clean gas flows therepast, with an attendant drop in pressure, toward the balance piston, ensuring that no dirty gas migrates in the opposite direction, toward the dry gas seals. The other labyrinth seal acts as a blow-down seal and provides a required pressure drop, such that the dry gas seals at the high-pressure end of the machine operates at the same pressure as the dry gas seal at the low pressure end of the machine.

While balance piston seals and gas balance seals are generally suitable for a variety of applications, it is commonly desirable to reduce shaft length, thereby increasing stiffness. However, when applied to seals, such reductions in shaft length are generally limited by a trade-off with sealing ability. What is needed is a seal assembly that maximizes sealing surface length while reducing, or at least not substantially increasing, the axial length of the shaft required for the balance piston and/or gas balance seal.

SUMMARY

Embodiments of the disclosure may provide an exemplary balance piston assembly. The assembly includes a balance piston coupled to a rotatable shaft and configured to rotate therewith, the balance piston including a first shelf and a second shelf, the first and second shelves being axially-overlapping and radially-offset. The assembly also includes a seal including a first sealing surface configured to seal with the first shelf and a second sealing surface configured to seal with the second shelf.

Embodiments of the disclosure may further provide an exemplary apparatus for sealing and balancing axial thrust. The apparatus includes a balance piston coupled to a rotatable shaft and including first and second radially-offset, parallel shelves and first and second axial sides. The first axial side is configured to communicate with a higher-pressure area and the second axial side configured to communicate with a lower-pressure area. The apparatus also includes a seal including first and second axially-overlapping, radially-offset sealing surfaces. The first sealing surface seals with the first shelf of the balance piston, and the second sealing surface seals with the second shelf to reduce migration of gas from the higher-pressure area to the lower-pressure area.

Embodiments of the disclosure may also provide an exemplary method for balancing thrust forces along a shaft. The method includes coupling a seal having first, second, and third radially-offset, axially-overlapping sealing surfaces with a balance piston having first and second shelves. The first and third sealing surfaces align with opposing radial sides of the first shelf, and the second sealing surface aligns with the second shelf, and wherein the balance piston is configured to rotate with the shaft. The method also includes referencing an outboard side of the balance piston to a reduced pressure as compared to a pressure applied to the inboard side of the balance piston.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
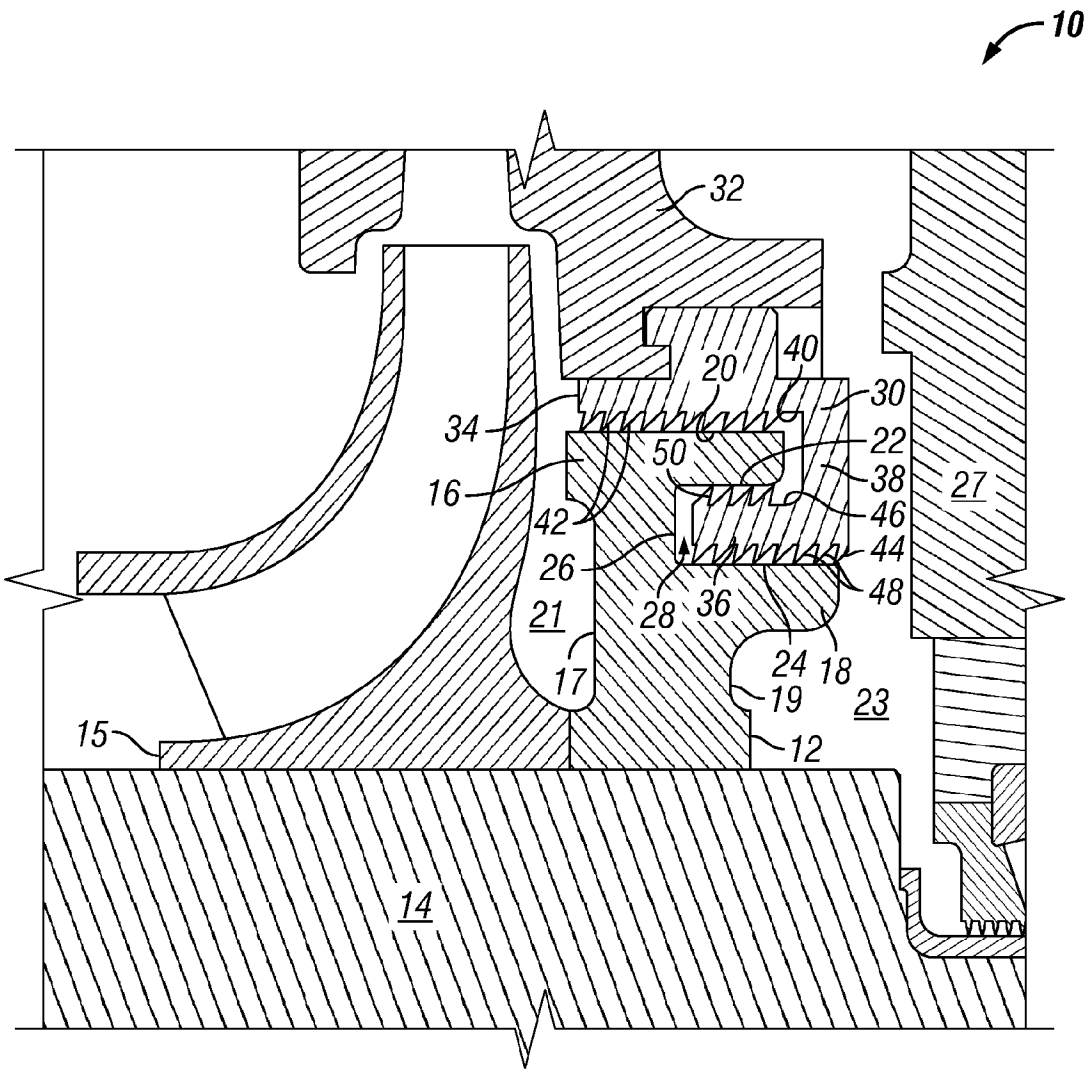
FIG. 1 illustrates a side cross-sectional view of an exemplary balance piston assembly, according to an embodiment.

It is to be understood that the following disclosure describes several exemplary embodiments for implementing different features, structures, or functions of the invention.

Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

FIG. 1 illustrates a side cross-sectional view of an exemplary balance piston assembly 10, according to an embodiment. The balance piston assembly 10 may be used in a centrifugal compressor; however, it will be appreciated that the balance piston assembly 10 may be configured for use with any turbomachine, such as any type of compressor (axial, centrifugal, etc.), turbine, pump, blower, fan, or the like. Further, various embodiments of the balance piston assembly 10 may be configured for use with other types of rotary machines.

The balance piston assembly 10 generally includes a balance piston 12 coupled to a rotatable shaft 14 and configured to rotate therewith. The balance piston 12 may be positioned proximal an impeller 15, for example, on a high-pressure (outlet) side thereof. The impeller 15 may be a final stage impeller in a multi-stage centrifugal compressor, may be part of a single-stage compressor, or may be an intermediate or any other compression stage. A first axial side 17 of the balance piston 12 faces the impeller 15 and a second axial side 19 of the balance piston 12 faces away from the impeller 15. The first axial side 17 communicates with a higher-pressure area 21 which may be generally defined between the impeller 15 and the balance piston 12, as shown. The second axial side 19 communicates with a lower-pressure area or cavity 23, defined between a head or other wall 27 and the balance piston 12. The cavity 23 is generally held at a lower pressure than the higher-pressure area 21; thus, a pressure differential is developed across the balance piston 12, providing an axial thrust toward the low-pressure cavity 23. This thrust serves to counteract axial thrusts developed in the opposite direction by the reverse pressure differential across the impeller 15.

The illustrated balance piston 12 includes a first shelf 16 and a second shelf 18, which are axially-overlapping and radially-offset from one another (i.e., the first shelf 16 has one or more points at the same axial location as one or more corresponding points on the second shelf 18, but the two shelves 16, 18 occupy space at different radial distances from the shaft 14), with the second shelf 18 being radially-closer to the shaft 14 than is the first shelf 16. In an embodiment, the first and second shelves 16, 18 may be substantially parallel and may be oriented axially (i.e., parallel to the shaft 14), radially (i.e., normal to the shaft 14), or any a combination thereof. The first shelf 16 may include a radially-outer surface 20 and a radially-inner surface 22. In an exemplary embodiment, the radially-outer surface 20 of the first shelf 16 may provide the outer radial extent of the balance piston 12; however, in other embodiments, the balance piston 12 may extend radially beyond the radially-outer surface 20 of the first shelf 16. Similarly, the second shelf 18 may include a radially-outer surface 24. An intermediate axial surface 26 of the balance piston 12 may extend between the radially-outer surface 24 of the second shelf 18 and the radially-inner surface 22 of the first shelf 16, so as to define a groove 28.

The balance piston assembly 10 also includes a seal 30. The seal 30 may be stationary with respect to the balance piston 12 and the rotatable shaft 14, and may be secured to a stationary support 32, which is coupled to or forms part of a compressor casing (not shown). The seal 30 may be coupled to the stationary support 32 and/or casing in any suitable fashion, such as by mechanical fasteners, resistance fits, interlocking connections, or the like. Further, the seal 30 may generally form a J-shape, for example. As such, the seal 30 may include radially-offset, axially-extending first and second sections 34, 36 and a third section 38 extending radially between the first and second sections 34, 36. The first section 34 may be aligned with the radially-outer surface 20 of the balance piston 12. The second section 36 may be received into the groove 28, such that it is disposed radially between the radially-inner surface 22 of the first shelf 16 and the radially-outer surface 24 of the second shelf 18.

The first section 34 may include a first sealing surface 40, which is disposed radially outside of the radial-outer surface 20 of the first shelf 16. In an exemplary embodiment, the first sealing surface 40 may include a plurality of teeth 42 extending radially-inward, toward the first shelf 16. The teeth 42 may be disposed in close proximity to the radially-outer surface 20, thereby providing a labyrinth seal. The provision of the labyrinth seal controls and reduces leakage of gas from the higher-pressure area 21 to the lower pressure cavity 23.

The second section 36 may include one or more additional sealing surfaces, for example, second and third sealing surfaces 44, 46, as shown. The second and third sealing surfaces 44, 46 may each include, for example, a plurality of teeth 48, 50, respectively. The teeth 48 of the second sealing surface 44 may extend radially-inward to seal with the radially-outer surface 24 of the second shelf 18. The teeth 50 of the third sealing surface 46 may extend radially-outward and seal with the radially-inner surface 22 of the first shelf 16. One, some, or all of the teeth 42, 48, 50 may be angled against gas flow, as shown; however, in other embodiments, any of the teeth 42, 48, 50 may extend straight radial or be otherwise angled, without departing from the scope of this disclosure.

The seal 30 and the balance piston 12 thus provide three radially-offset, axially-overlapping sealing interfaces: one each between the first sealing surface 40 and the radially-outer surface 20 of the first shelf 16, the second sealing surface 44 and the radially-outer surface 24 of the second shelf 18, and the third sealing surface 46 and the radially-inner surface 22 of the first shelf 16. In an exemplary embodiment, one or more of the first, second, and/or third sealing surfaces 40, 44, 46 may be disposed in a radial (i.e., perpendicular to the shaft 14) orientation, or may be positioned at some orientation in between axial and radial. Moreover, any of the first, second, and third sealing surfaces 40, 44, 46 may be parallel to one another. As such, the seal 30 provides increased sealing area, and, for example, does not necessitate significant additional axial length, as will be explained in further detail below. Although three sealing interfaces are shown and described herein, it will be appreciated that any number of sealing interfaces (2, 3, 4, 12, 24, etc.) may be provided, consistent with the present disclosure, according to a variety of factors apparent to one with skill in the art.

In various exemplary embodiments, the seal 30 may be a single, unitary or "monolithic" structure. Accordingly, to install the seal 30 on the balance piston 12, the seal 30 may slide over an end (not shown) of the shaft 14 and into position. In another exemplary embodiment, the seal 30 may be horizontally split. As such, the seal 30 may be broken into two or more arcuate segments that can be placed around the shaft 14 at a desired location, connected (e.g., fastened, welded, latched, etc.) together, and positioned as desired. Additionally or alternatively, the seal 30 may be split into two or more sections, such that the first and second sections 34, 36 are separate. In such embodiments, the third section 38 may be bifurcated or otherwise segmented, with part connected with each of the first and second sections 34, 36 or the third section 38 may be wholly attached to one or the other sections 34, 36 and detached from the other. The first, second, and third sections 34, 36, 38 may also be horizontally split into segments, such that the sections 34-38 are pieced together during installation at a desired point on the shaft 14. In another embodiment, the sections 34-38 may not be horizontally split and may be slid individually over the end (not shown) of the shaft 14 and into position.

Figure 2:
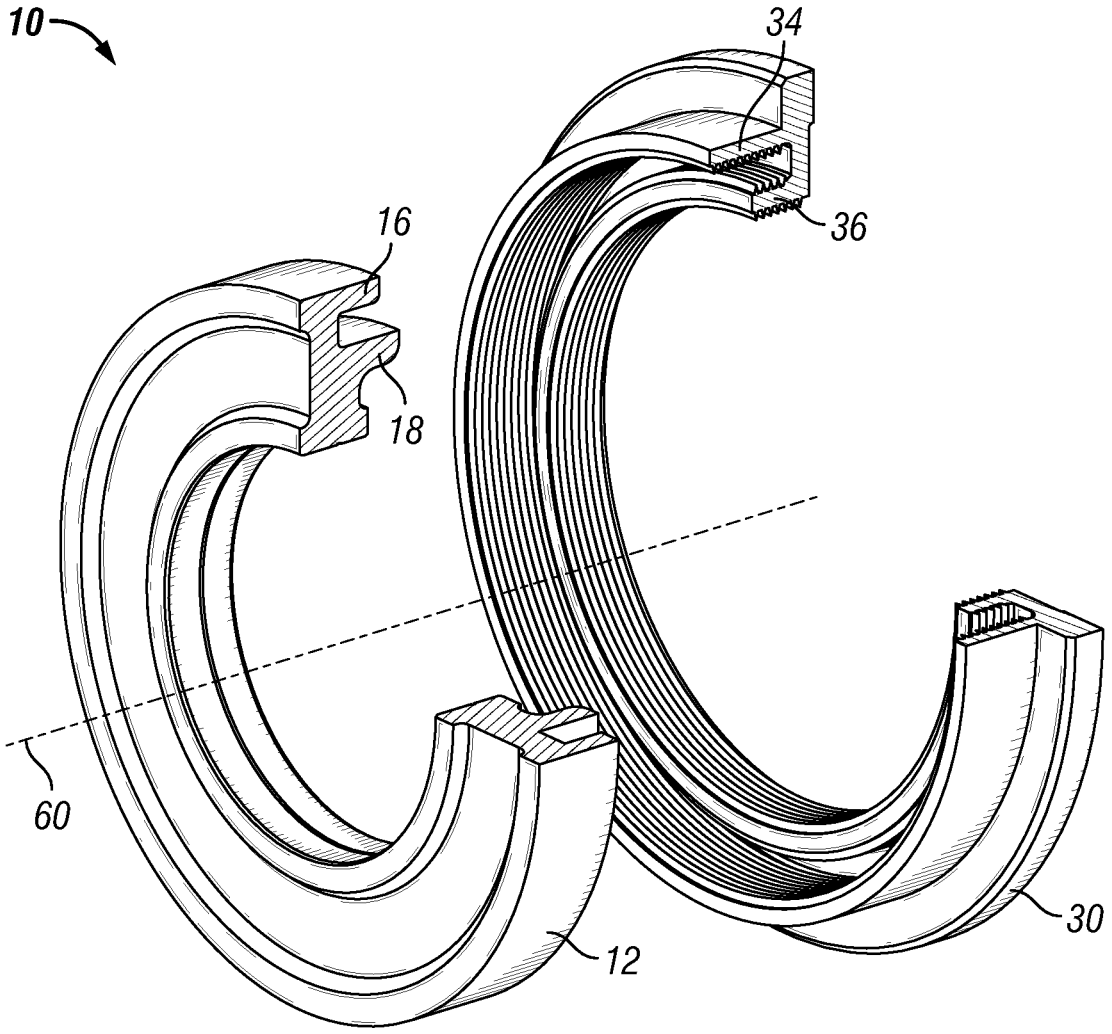
FIG. 2 illustrates an isometric, exploded, quarter-sectional view of the balance piston assembly, according to an embodiment.

FIG. 2 illustrates an isometric, exploded, quarter-sectional view of the exemplary balance piston assembly 10, according to an embodiment. The seal 30 and the balance piston 12 are generally annular and may be concentrically positioned about a common axis 60. The balance piston 12 and the seal 30 may be disposed around the shaft 14 (FIG. 1), with the balance piston 12 closely-toleranced around the shaft 14 and, for example, secured for rotation therewith. In an exemplary embodiment, the balance piston 12 may be fixed in position around the shaft 14, and the seal 30 then slid into position, such that the first and second sections 34, 36 of the seal 30 align with the first and second shelves 16, 18, respectively.

In some exemplary embodiments, especially when employed in axially or horizontally split compressors (or other rotary machines), it may be desirable for the seal 30 to be split into arcuate sections to facilitate removal. For example, the seal 30 may be split into two 180 degree sections each connected end-on-end at a seam (not shown). When the top of the axially split casing (not shown) is removed, the sections of the seal 30 can be individually removed straight out (i.e., rolled out), rather than having to remove the entire rotor and sliding the seal 30 over the end of the shaft 14.

Referring now to FIGS. 1 and 2, in exemplary operation, the balance piston assembly 10 provides a counter-thrust on the shaft 14, as the balance piston 12 experiences a pressure differential between its high-pressure axial side 17 and its low-pressure axial side 19. Further, the seal 30 maintains this pressure differential, avoiding or at least reducing gas leakage across the balance piston 12. Since the seal 30 and balance piston 12 provide two or more (e.g., three, as shown) radially-offset, axially-overlapping sealing interfaces, the balance piston assembly 10 provides greater sealing and reduced leakage as compared to other balance piston assemblies (not shown) of equal axial width.

Figure 3:
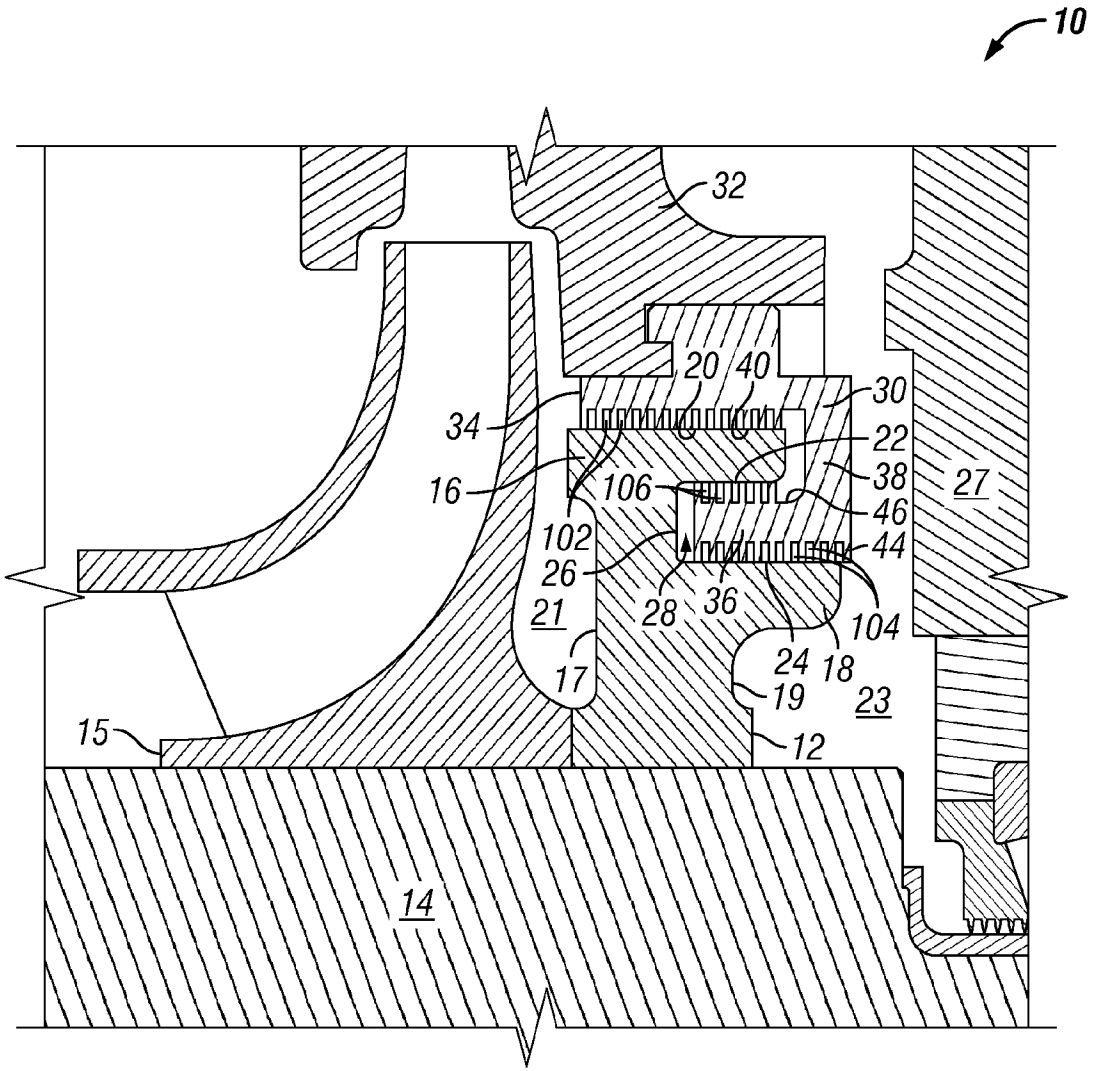
FIG. 3 illustrates a side cross-sectional view of another exemplary balance piston assembly, according to an embodiment.

FIG. 3 illustrates a side cross-sectional view of another exemplary embodiment of the balance piston assembly 10. Rather than teeth 42, 48, 50, the seal 30 illustrated in FIG. 3 includes three pluralities of holes 102, 104, 106 bored or otherwise formed in the first, second, and third sealing surfaces 40, 44, 46, respectively. Accordingly, the seal 30 may provide three (or more or fewer, as desired) hole pattern or damper-type sealing surfaces. It will be appreciated, however, that embodiments where one or more sealing surfaces 40, 44, 46 include a labyrinth seal and the remaining sealing surfaces 40, 44, 46 provide a hole pattern seal (i.e., combining the sealing elements of FIGS. 1 and 3) are expressly contemplated herein and may be employed by one with skill in the art. Further, in some embodiments, one or more of the sealing surfaces 40, 44, 46 may include a combination of both holes and teeth.

Furthermore, although labyrinth and hole-pattern seals are shown, it will be appreciated that other types of sealing surfaces may also be provided, such as honeycomb seals, as are known in the art. Briefly, in such a honeycomb seal embodiment, one or more of the holes 102, 104, 106 may replaced with a lattice structure, providing a network of recesses, which perform generally the same function as the holes in the hole-pattern seal. Again, it will be appreciated that combinations of sealing structures may be provided by a single seal 30 or even by a single sealing surface 40, 44, 46. For example, in one embodiment, the first sealing surface 40 may provide a labyrinth seal, the second sealing surface 44 may provide a hole-pattern seal, and the third sealing surface 46 may provide a honeycomb seal. In other embodiments, one or more of the surfaces 40, 44, 46 may provide a brush seal, or any other type of seal. It will be appreciated that this configuration is just one combination among many contemplated and should not be considered limiting.

Figure 4:
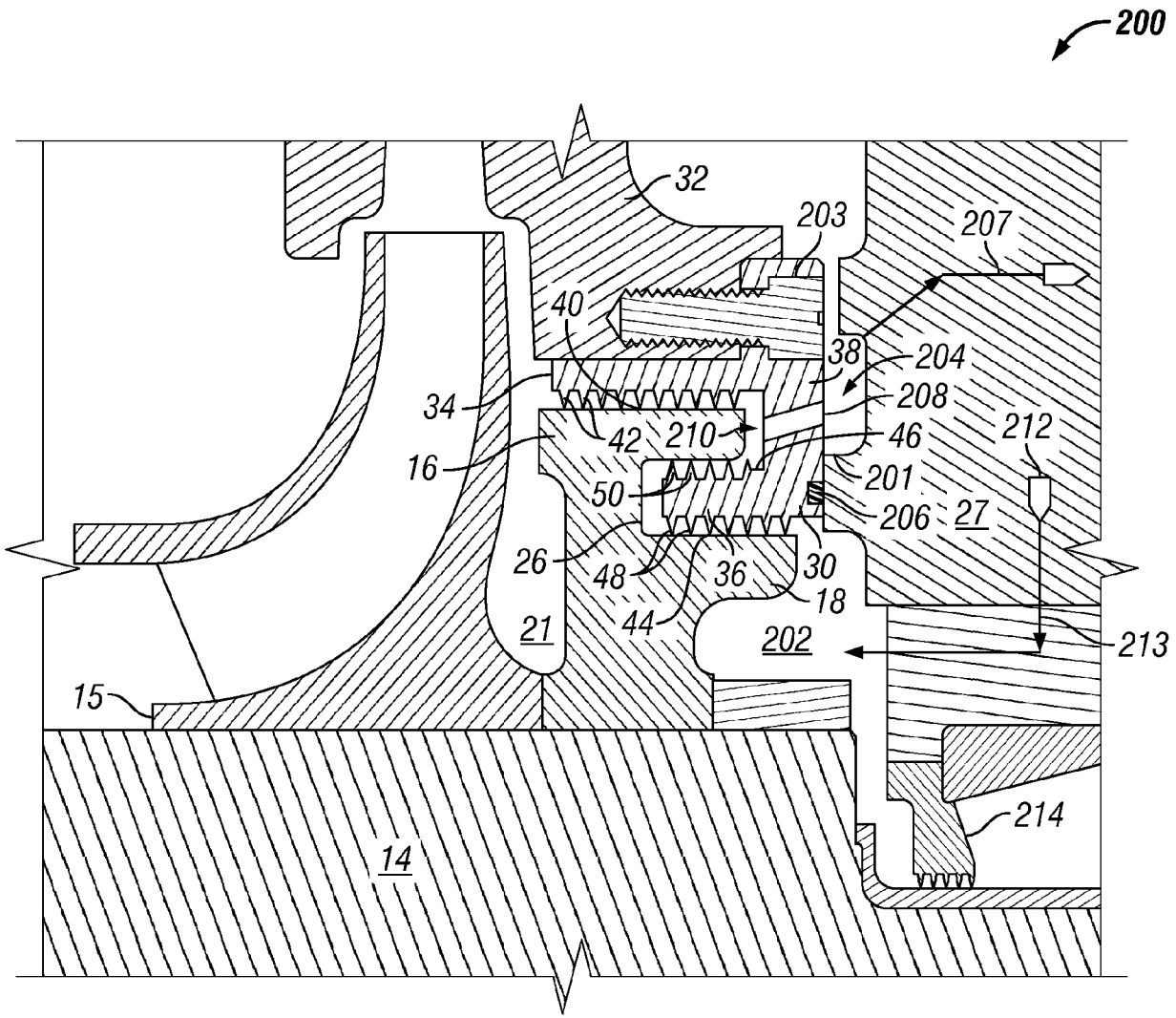
FIG. 4 illustrates a side cross-sectional view of another exemplary balance piston assembly, according to an embodiment.

FIG. 4 illustrates a side cross-sectional view of another exemplary balance piston assembly 200, according to an embodiment. The balance piston assembly 200 may be similar in structure and function to the balance piston assembly 10 and, as such, like elements are indicated with like reference numerals and are not described in duplicate herein. Unlike the exemplary embodiment of the balance piston assembly 10 shown in FIG. 1, however, the seal 30 of the balance piston assembly 200 extends axially to seal with the head 27, for example, with an axial extension 201 thereof. Accordingly, the seal 30 bifurcates the cavity 23 (FIG. 1) into first and second cavities 202, 204. A sealing element, such as an O-ring 206, may be disposed between the seal 30 and the head 27 to ensure a fluid-tight engagement therebetween. Further, the seal 30 is coupled to the stationary support 32 via one or more bolts 203. The second cavity 204 may be fluidly coupled with a conduit 207, as schematically represented, which may vent to an exterior of the compressor or to another location for recycle of gas received through the conduit 207.

The seal 30 may further define a gas flow port 208 extending through the third section 38 thereof. The gas flow port 208 may be a single hole, as shown, or may be a plurality of holes or slots disposed in any radial and/or circumferential pattern or interval deemed suitable by one with skill in the art. The gas flow port 208 may thus provide fluid communication between the second cavity 204 and a cavity 210 defined between the third section 38 (e.g., the intermediate axial surface 26) of the seal 30 and the first shelf 16 of the balance piston 12.

In operation, the balance piston assembly 200 may serve dual functions by not only providing the balance thrust force described above, but also providing at least part of a gas balance seal. As described above, the gas balance seal is typically provided by two labyrinth seals. In the balance piston assembly 200, the need for at least one of these gas balance labyrinth seals is obviated, thereby reducing the axial shaft 14 length otherwise taken up by such seals. Gas is injected into the first cavity 202 from a source 212 via port 213, as schematically represented. The gas is generally prevented from travelling axially away from the balance piston assembly 200 by a seal 214, beyond which dry gas seals, or other seals, may be disposed (not shown). The gas injected into the first cavity 202 thus travels past the teeth 48 and 50 of the second section 36 of the seal 30 and into the cavity 210. Meanwhile, process gas from the higher-pressure area 21 travels past the teeth 42 of the first section 34 of the seal 30 and also into the cavity 210. The gas in the cavity 210 is then vented via the gas flow port 208 and into the second cavity 204, whereafter it is further vented via the conduit 207 and/or other additional conduits, ports, etc., and then released, recycled, reconditioned, or otherwise disposed of in any suitable manner.

Figure 5:
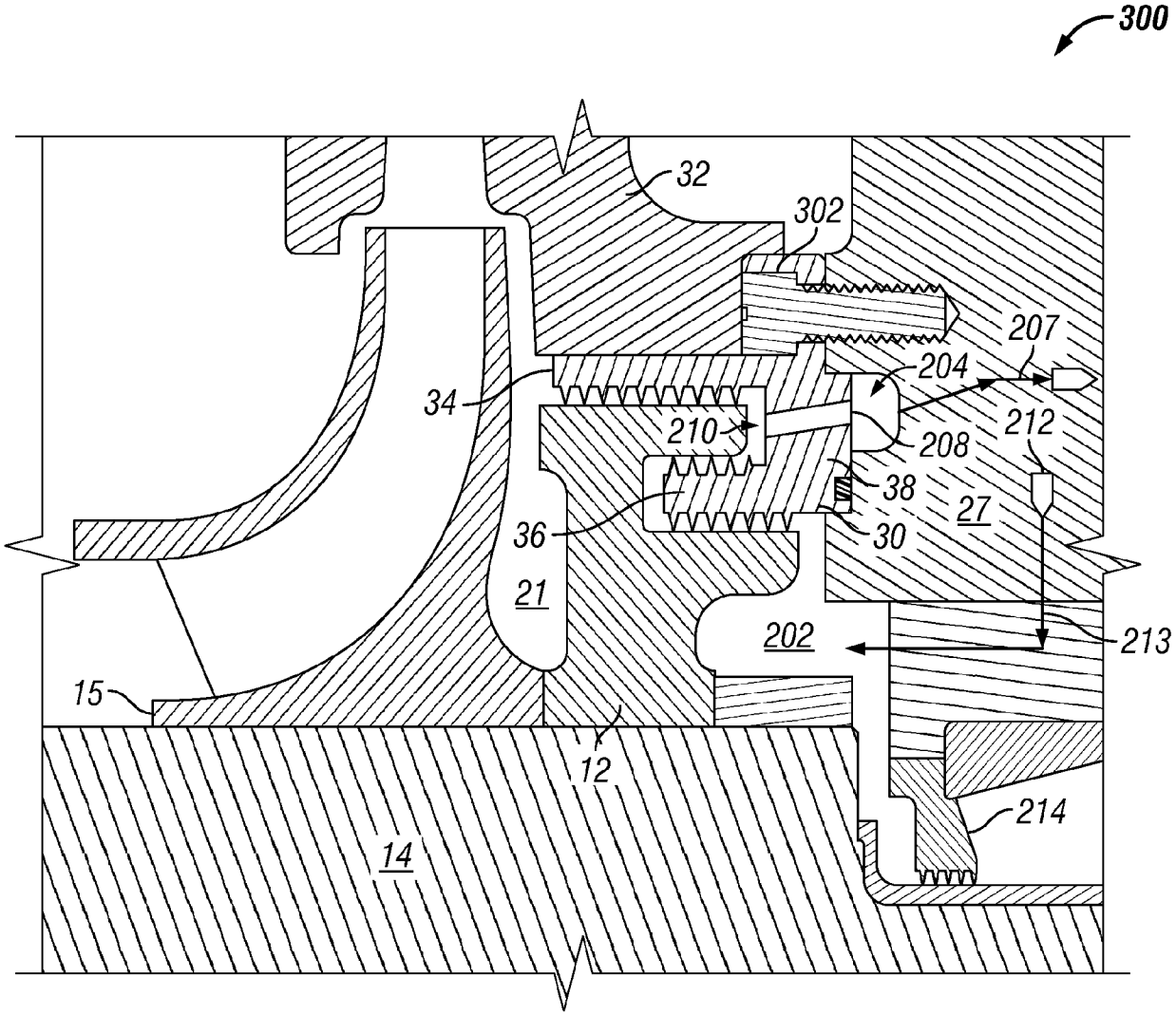
FIG. 5 illustrates a side cross-sectional view of another exemplary balance piston assembly, according to an embodiment.

FIG. 5 illustrates a side cross-sectional view of another exemplary balance piston assembly 300, according to an embodiment. The balance piston assembly 300 may be similar in structure and function to balance piston assemblies 10 and 200; as such, like elements are indicated with like numerals and will not be described in duplicate. The seal 30 of balance piston assembly 300 is coupled to the head 27 with a bolt 302 extending therethrough. As such, the seal 30 engages the head 27 on both radial sides of the second cavity 204, thereby preventing fluid flow from leaking out of the second cavity 204, except through the conduit 207. Further, connecting the seal 30 to the head 27 provides two points of axial support for the seal 30 against the head 27, preventing the seal 30 from misaligning under the pressure differentials created across its sections 34, 36, 38. It will be appreciated that the seal 30 may be secured at two axial points to the head 27 in various other ways, such as by welding, brazing, or the like, without departing from the scope of this disclosure.

Figure 6:
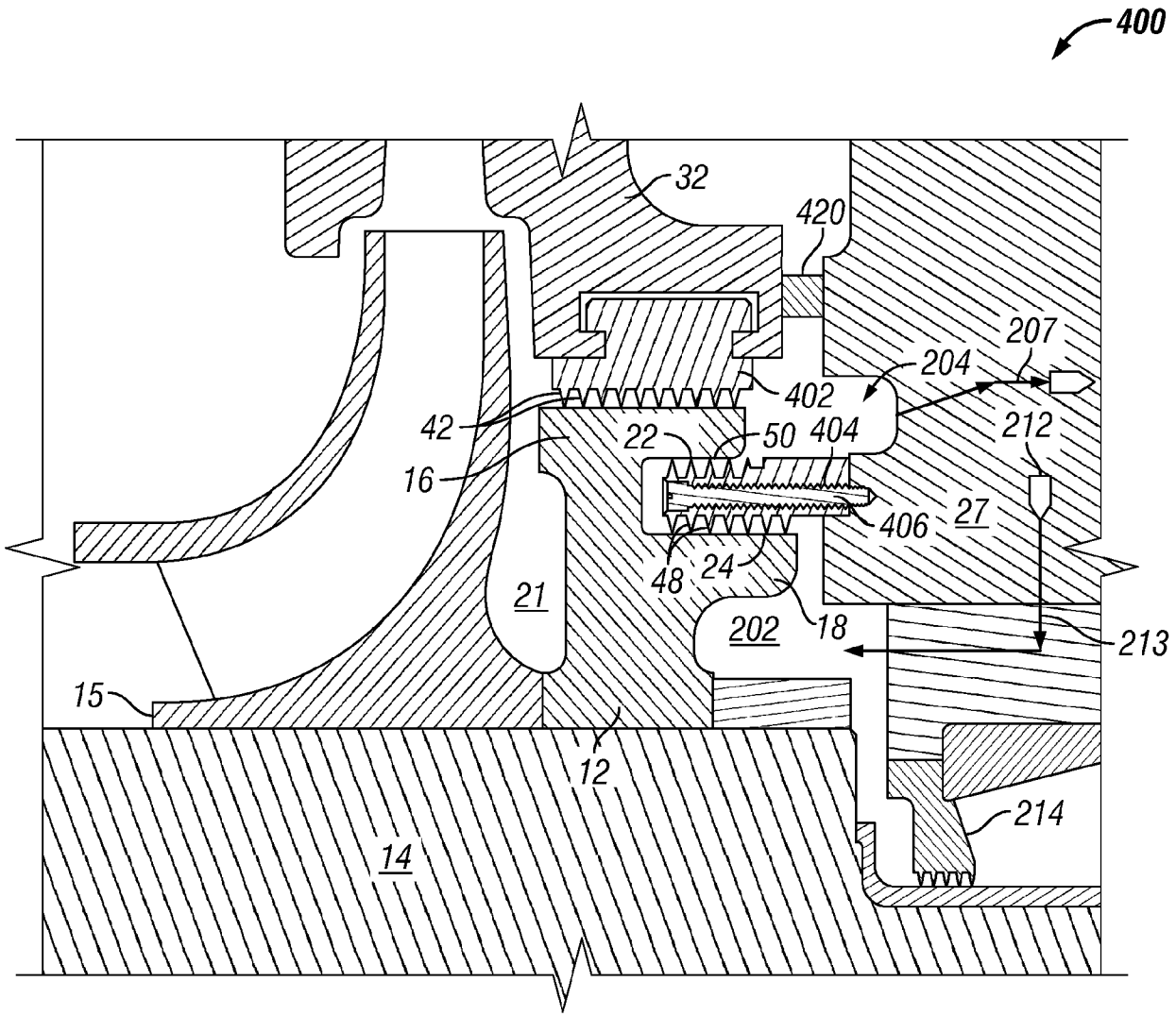
FIG. 6 illustrates a side cross-sectional view of another exemplary balance piston assembly, according to an embodiment.

FIG. 6 illustrates a side cross-sectional view of yet another exemplary balance piston assembly 400, according to an embodiment. The balance piston assembly 400 may be similar in structure and function to any of the balance piston assemblies 10, 200, and/or 300; as such, like elements are indicated with like numerals and will not be described in duplicate. The seal 30 of the balance piston assembly 400 may be segmented, for example, into two radially-offset and axially-overlapping annular seal sections 402, 404, which may be discrete from one another in whole or in part. It will be appreciated that the seal sections 402, 404 may each be further segmented into arcuate sections to facilitate installation and removal and described above.

The first annular seal section 402 is aligned with the first shelf 16 of the balance piston 12 and is configured to seal therewith, for example, providing the teeth 42. The second annular seal section 404 may be aligned between the first and second shelves 16, 18 and may be configured to seal with both. For example, the second annular seal section 404 may provide the teeth 48 and 50 to seal with the radially-outer surface 24 of the second shelf 18 and the radially-inner surface 22 of the first shelf 16, respectively. Further, the second annular seal section 404 may be secured to the head 27 via one or more bolts 406. By segmenting the seal 30 into the first and second annular seal sections 402, 404, the balance piston assembly 400 may provide the gas labyrinth seal function, without necessitating a gas flow port extending therethrough.

Further, in one exemplary embodiment, the balance piston assembly 400 may include a sealing member 420. The sealing member 420 may be an O-ring, for example, and elastomeric O-ring, but may also be any other suitable metallic (as shown) or other material. The sealing member 420 may block fluid communication out of the 204, forcing it to proceed out through the conduit 207. In other embodiments, the sealing member 420 may not be required and may thus be omitted.

Figure 7:
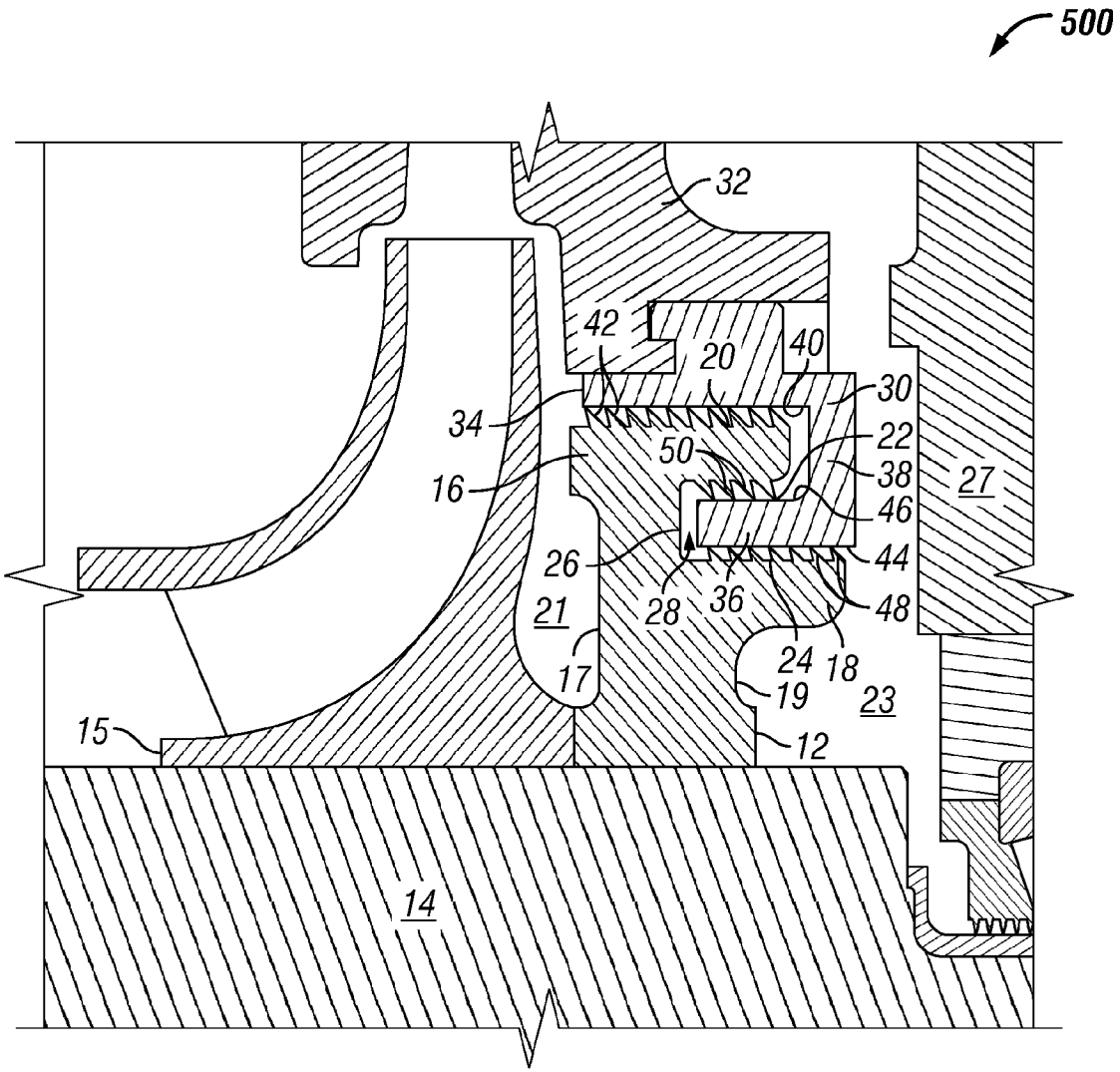
FIG. 7 illustrates a side cross-sectional view of another exemplary balance piston assembly, according to an embodiment.

FIG. 7 illustrates a side cross-sectional view of another exemplary balance piston assembly 500, according to an embodiment. The balance piston assembly 500 may be similar to the balance piston 10, and may thus be best understood with reference thereto. As such, like elements are given like numbers and will not be described again. In the balance piston assembly 500, the rotating surfaces 22, 24, 26 of the balance piston 12 include the teeth 42, 48, 50 respectively, rather than the surfaces 40, 44, 46 of the seal 30, in contrast to the balance piston 10. Accordingly, the seal 30 may include an abradable surface, as are known in the art, to seal with the balance piston 12. In will be appreciated that, in other embodiments, for example, in any of the balance piston assemblies 10, 200, 300, 400, 500, and/or others, one or more of the sealing surfaces 22, 24, 26 of the balance piston 12 may include teeth, while one or more of the sealing surface sides 42, 48, 50 of the seal 30 may include teeth. As such, in some embodiments, both the balance piston 12 and the seal 30 may provide teeth, without departing from the scope of the disclosure. Furthermore, one or more other types of sealing structures may be readily substituted for any of the teeth 42, 48, 50 as described above.

Figure 8:
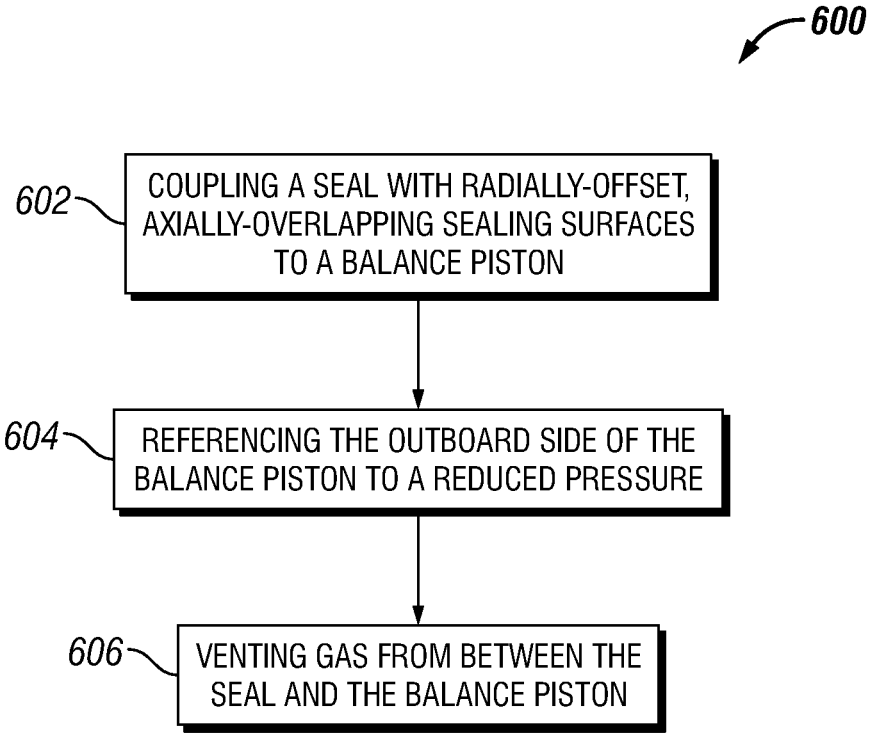
FIG. 8 illustrates a flowchart of an exemplary method for at least partially sealing a rotor, according to an embodiment.

FIG. 8 illustrates a flowchart of an exemplary method 600 for balancing thrust along a shaft, according to an embodiment. The method 600 may proceed by operation of one or more of the balance piston assemblies 10, 200, 300, 400, 500 described above and may thus be best understood with reference thereto. The method 600 includes coupling a seal having first, second, and third radially-offset, axially-overlapping sealing surfaces with a balance piston having first and second shelves, as at 602. The first sealing surface aligns with a radially-outer surface of the first shelf, the second sealing surface aligns with the second shelf, and the third sealing surface aligns with a radially-inner surface of the first shelf. Further, the balance piston is configured to rotate with the shaft. The method 600 also includes referencing an outboard side of the balance piston to a reduced pressure as compared to a pressure applied to the inboard side of the balance piston, as at 604.

Moreover, in an exemplary embodiment, the method 600 may include venting gas from an area defined between the seal and the balance piston to provide at least a portion of a gas balance seal, as at 606. The vented gas may at least partially originate in the system as clean gas injected to an area outboard of the balance piston, which then migrates through at least one of the sealing surfaces. This clean gas may protect other components, such as dry gas seals, from contamination by process gas or other fouling agents. Further, the vented gas may also at least partially originate for process gas that migrates across the balance piston.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

We claim:

1. A balance piston assembly, comprising:

a balance piston coupled to a rotatable shaft and configured to rotate therewith, the balance piston including a first shelf and a second shelf, the first and second shelves being axially-overlapping and radially-offset; and a seal including a first sealing surface configured to seal with the first shelf and a second sealing surface configured to seal with the second shelf, wherein the seal further includes a third sealing surface disposed radially between the first and second sealing surfaces, and wherein the first shelf of the balance piston includes a radially-outer surface configured to seal with the first sealing surface and a radially-inner surface configured to seal with the third sealing surface.

2. The balance piston of claim 1, wherein the seal has a substantially J-shape.

3. The balance piston assembly of claim 1, wherein the first shelf includes a plurality of teeth configured to seal with the first sealing surface.

4. The balance piston assembly of claim 1, wherein the seal and the balance piston define a continuous flowpath between the first, second, and third sealing surfaces.

5. The balance piston assembly of claim 1, wherein at least one of the radially-outer surface and the radially-inner surface includes a plurality of teeth.

6. The balance piston assembly of claim 1, wherein at least one of the first and second sealing surfaces provides at least part of a damper seal, a honeycomb seal, a hole pattern seal, a labyrinth seal, or a combination thereof.

7. The balance piston assembly of claim 1, wherein the seal extends axially away from the balance piston and engages a header to at least partially define a cavity therebetween.

8. The balance piston assembly of claim 7, wherein the seal defines a gas flow port extending therethrough, the gas flow port being configured to fluidly connect an area positioned between the first and second sealing surfaces and the balance piston with a conduit fluidly communicating with the cavity.

9. The balance piston assembly of claim 1, wherein the seal is segmented into first and second radially-offset, axially-overlapping annular sections, the first section including the first sealing surface and the second section including the second sealing surface.

10. An apparatus for sealing and balancing axial thrust, comprising:

a balance piston coupled to a rotatable shaft and including first and second radially-offset, parallel shelves and first and second axial sides, the first axial side configured to communicate with a higher-pressure area and the second axial side configured to communicate with a lower-pressure area; and a seal including first and second axially-overlapping, radially-offset sealing surfaces, the first sealing surface sealing with the first shelf of the balance piston and the second sealing surface sealing with the second shelf to reduce migration of gas from the higher-pressure area to the lower-pressure area, wherein the first shelf includes a radially-outer surface and a radially-inner surface, and the seal includes a third sealing surface disposed radially between the first and second sealing surfaces, the first sealing surface of the seal configured to seal with the radially-outer surface of the first shelf, and the third sealing surface of the seal configured to seal with the radially-inner surface of the first shelf.

11. The apparatus of claim 10, wherein at least one of the first, second, and third sealing surfaces includes teeth for a labyrinth-type seal, holes for a hole-pattern-type seal, or a combination thereof.

12. The apparatus of claim 10, wherein the seal is horizontally split, axially split, or both.

13. The apparatus of claim 10, wherein the seal defines a gas flow port extending therethrough to fluidly communicate an area between the seal and the balance piston with a conduit defined outside of the area.

14. The apparatus of claim 13, wherein the seal extends away from the balance piston and engages a header and defines a cavity at least partially therewith, the conduit extending from the cavity and the cavity fluidly communicating with the area via the gas flow port.

15. A method for balancing thrust forces along a shaft, comprising:

coupling a seal having first, second, and third radially-offset, axially-overlapping sealing surfaces with a balance piston having first and second shelves, wherein the first and third sealing surfaces align with opposing radial sides of the first shelf, and the second sealing surface aligns with the second shelf, and wherein the balance piston is configured to rotate with the shaft; and referencing an outboard side of the balance piston to a reduced pressure as compared to a pressure applied to the inboard side of the balance piston.

16. The method of claim 15, further comprising:

injecting gas into a first cavity defined on an outboard side of the balance piston;

directing the gas past the second and third sealing surfaces and into an area defined between the balance piston and the seal; and directing process gas past the first sealing surface and into the area.

17. The method of claim 16, further comprising venting gas from the area to a second cavity defined on the outboard side of the balance piston.

* * * * *